US007037079B2

(12) United States Patent
Wettstein et al.

(10) Patent No.: US 7,037,079 B2
(45) Date of Patent: May 2, 2006

(54) AXIAL-FLOW THERMAL TURBOMACHINE

(75) Inventors: Hans Wettstein, Fislisbach (CH); Mohamed Nazmy, Fislisbach (CH); Claus Paul Gerdes, Ruetihof (CH)

(73) Assignee: ALSTOM Technology Ltd., Baden (SE)

( * ) Notice: Subject to any disclaimer, the term of this patent is extended or adjusted under 35 U.S.C. 154(b) by 75 days.

(21) Appl. No.: 10/808,493

(22) Filed: Mar. 25, 2004

(65) Prior Publication Data

US 2006/0062674 A1 Mar. 23, 2006

(30) Foreign Application Priority Data

Mar. 26, 2003 (DE) ..... 103 13 490

(51) Int. Cl.
*F01D 5/30* (2006.01)

(52) U.S. Cl. ..... 416/215

(58) Field of Classification Search ..... 416/215–218
See application file for complete search history.

(56) References Cited

U.S. PATENT DOCUMENTS 2,857,134 A * 10/1958 Arkless ..... 416/216
4,743,166 A * 5/1988 Elston et al. ..... 416/215
5,008,072 A * 4/1991 Siga et al. ..... 420/69
5,741,119 A * 4/1998 Heppenstall ..... 416/219 R

FOREIGN PATENT DOCUMENTS

| | | |
|---|---|---|
| CH | 424 807 | 5/1967 |
| DE | 0 513 407 B1 | 7/1995 |
| DE | 101 10 102 A1 | 8/2002 |
| WO | 99/27234 | 6/1999 |

OTHER PUBLICATIONS

Search Report from DE 103 13 490.5 (Sep. 24, 2003).

* cited by examiner

*Primary Examiner*—Edward K. Look
*Assistant Examiner*—Devin Hanan
(74) *Attorney, Agent, or Firm*—Cermak & Kenealy, LLP; Adam J. Cermak

(57) ABSTRACT

The invention relates to an axial-flow thermal turbomachine, having a rotor (1) made from a metallic material with a first density ($D_1$), in which rotor blades (3, 3') and intermediate pieces (4) are mounted alternately in a circumferential groove. It is characterized in that said intermediate pieces (4) consist of a material with a second density ($D_2$), which is lower than the first density ($D_1$). Particularly suitable materials for the intermediate pieces (4) are intermetallic compounds, preferably intermetallic γ-titanium aluminide alloys or intermetallic orthorhombic titanium aluminide alloys, but also titanium alloys.

6 Claims, 1 Drawing Sheet

AXIAL-FLOW THERMAL TURBOMACHINE

BACKGROUND OF THE INVENTION

1. Field of the Invention

The invention deals with the field of power plant technology. It relates to an axial-flow thermal turbomachine which has a reduced rotor weight compared to the known prior art.

2. Discussion of Background

Thermal turbomachines, e.g. high-pressure compressors for gas turbines or turbines, substantially comprise a rotor fitted with rotor blades and a stator, in which guide vanes are mounted. The rotor blades and guide vanes each have a main blade section and a blade root. To enable the blades and vanes to be secured to the rotor or in the stator, grooves are formed in the stator and on the rotor shaft. The roots of the guide vanes and rotor blades are pushed into these grooves and then held in place.

The stationary guide vanes serve the purpose of diverting the flow of the gaseous medium which is to be compressed or expanded onto the rotating rotor blades in such a way that the energy is converted with optimum efficiency.

It is known to produce blades and vanes integrally from a single material, e.g. from stainless steel for gas turbine compressors or from a nickel-base superalloy for gas turbines and to use these identical blades or vanes to produce a row of blades or vanes. Blades or conventional blades.

For certain applications, the mean mass of a row of blades is limited by the load-bearing capacity of the rotor.

Therefore, there are known solutions for producing blades in a hybrid form. In the case of the hybrid form, different materials with different physical properties are combined with one another to produce a blade in order to obtain an optimum blade design. For example, a hybrid rotor blade for an engine, in which the trailing edge of the main blade section, which has only an aerodynamic function, is made from a lightweight material, preferably a fiber composite material, e.g. carbon fiber composite material, is known from DE 101 10 102 A1. A (lightweight) trailing edge of this type advantageously makes it possible to reduce the weight of the blade. The two parts of the main blade section (heavy metallic leading edge and lightweight trailing edge made from fiber composite material) are joined by adhesive bonding or riveting.

A similar solution is described in WO 99/27234, which discloses a rotor with integral blading, in particular for an engine, on the circumference of which rotor blades are arranged, the rotor blades, in order to reduce vibrations, having a metallic blade root, a metallic main blade section, which forms at least part of the blade leading edge and of the adjoining region of the blade surface, and a main blade section made from fiber-reinforced plastic. In this case too, the main blade section made from plastic is secured to the metallic part of the main blade section by adhesive bonding/riveting or by means of a clamp fit.

This known prior art has the drawbacks listed below. Firstly, the abovementioned forms of attachment are unable to withstand high loads over the course of a prolonged period of time, and secondly the fiber-reinforced plastics can only be used in certain temperature ranges, and consequently these known technical solutions are only suitable in particular for engine technology. Moreover, the characteristics of the main blade section (mechanical properties, resistance to oxidation, frictional properties) are altered compared to those of the main blade sections which consist of a single material, and this can have an adverse effect on the operating performance of the engine.

Furthermore, EP 0 513 407 B1 has disclosed a turbine blade made from an alloy based on a dopant-containing gamma-titanium aluminide, which comprises main blade section, blade root and if appropriate blade covering strip. During production of this blade, the casting is partially heat-treated and hot-formed in such a manner that the main blade section then has a course-grained structure, which leads to a high tensile strength and creep rupture strength, and that the blade root and/or the blade cover strip has a fine-grain structure, which leads to an increased ductility compared to the main blade section. Although the use of these blades advantageously reduces the mass of the rotor compared to conventional blades, a drawback of this prior art is that the blade tips, on account of their brittleness, flake off when they come into contact with the stator during operation. However, it is not normally possible to prevent this.

SUMMARY OF THE INVENTION

It is an object of the invention to avoid the abovementioned drawbacks of the prior art. The invention is based on the object of developing a thermal turbomachine in which the service life of the rotor is extended on account of a reduced weight.

According to the invention, this object can be achieved, in the case of a thermal turbomachine, by virtue of the fact that the intermediate pieces between the rotor blades of a row of blades are formed of a material which has a lower density than the density of the rotor material. Materials which are preferably suitable for this purpose include intermetallic compounds or titanium alloys.

The advantages of the invention consist in the fact that firstly the weight of the rotor is reduced as a result, and secondly the brittleness of the intermetallic intermediate pieces does not represent any increased risk to operation of the turbomachine.

It is advantageous if the intermediate pieces consist of an intermetallic γ-TiAl compound or an intermetallic orthorhombic TiAl compound, since this use of materials in accordance with the invention leads to a considerable reduction in the weight of the rotor. The relative density of the intermetallic titanium aluminide compounds is only 50% of the density of stainless Cr—Ni—W steel.

It may also be expedient to use a titanium alloy instead of the intermetallic titanium aluminide compound as material for the abovementioned intermediate pieces. On account of the slightly higher density, the reduction in the weight of the rotor compared to conventional rotors is then slightly less.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which illustrate an exemplary embodiment of the invention. The only figure shows a cross section through the rotor according to the invention of a high-pressure compressor for a gas turbine.

DESCRIPTION OF THE PREFERRED EMBODIMENTS

Figure 1:
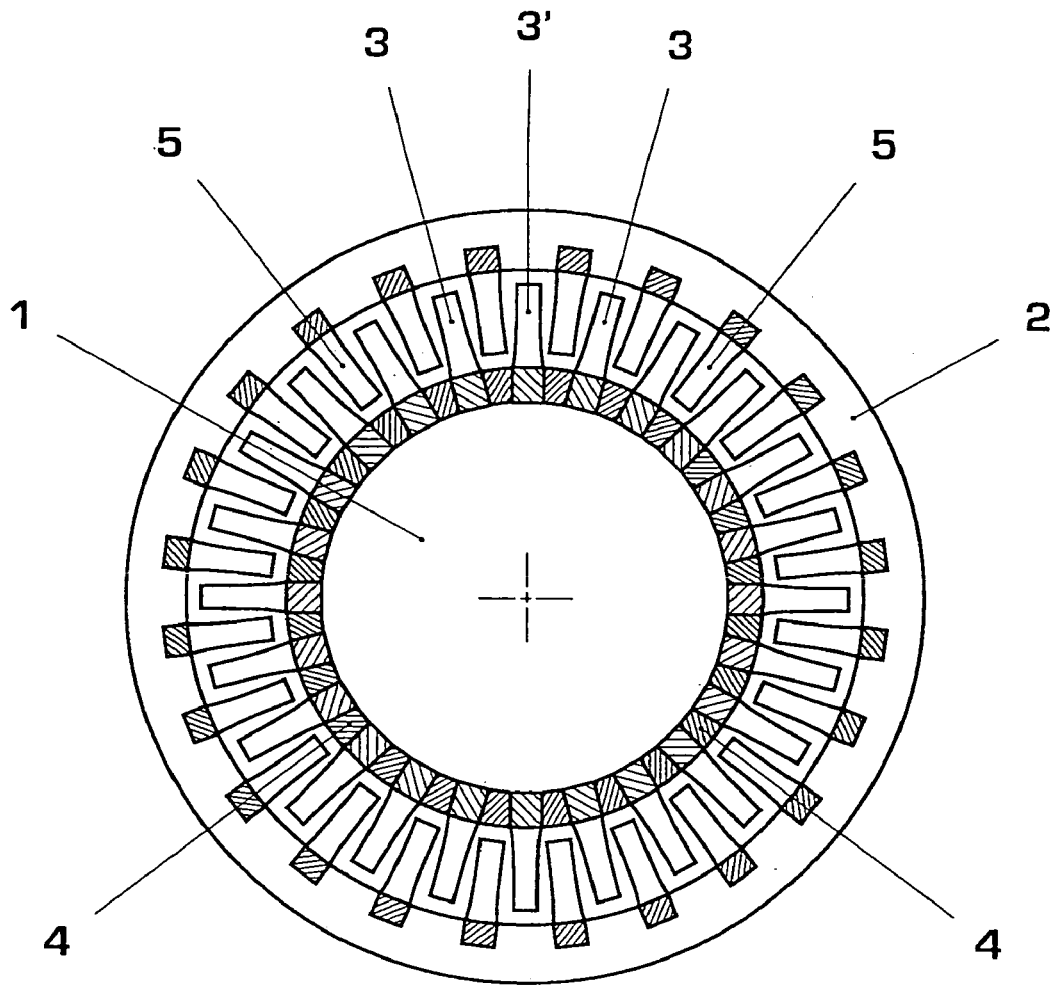

The invention is explained in more detail below on the basis of an exemplary embodiment and with reference to FIG. 1.

FIG. 1 shows a cross section through a row of rotor blades belonging to a rotor 1 for a high-pressure compressor of a gas turbine. The rotor 1 is surrounded by a stator 2. Rotor blades 3, 3' are mounted in a circumferential groove in the rotor 1, while guide vanes 5 are secured in the stator 2. The blades and vanes 3, 3', 5 are, for example, exposed to a pressure of approx. 32 bar and a temperature of approx. 600° C. for several thousand hours. They consist of a stainless Cr—Ni—W steel of the following chemical composition (in % by weight): 0.12 C, <0.8 Si, <1.0 Mn, 17 Cr, 14.5 Ni, <0.5 Mo, 3.3 W, <1 Ti, <0.045 P, <0.03 S, remainder Fe. The shaft of the rotor 1 likewise consists of steel. The density of steel is approx. 7.9 g/cm$^3$.

In a row of rotor blades of the rotor 1, intermediate pieces 4 are mounted in the circumferential groove in the rotor 1 between each pair of adjacent rotor blades 3 and 3'. According to the invention, these intermediate pieces 4 are made from an intermetallic compound, in this case from a γ-titanium aluminide compound.

This intermetallic compound used to produce the intermediate pieces 4 has the following chemical composition (in % by weight) Ti-(30.5–31.5)Al-(8.9–9.5)W-(0.3–0.4)Si.

Intermetallic compounds of titanium with aluminum have a number of advantageous properties which makes them appear attractive as structural materials in the medium and relatively high temperature ranges. These include their lower density compared to superalloys and compared to stainless steels. However, their brittleness is often an obstacle to their technical use in their current form.

The above-described intermetallic γ-titanium aluminide compound is distinguished by a density which is approximately 50% lower than that of the steel used for the rotor and the blades in this exemplary embodiment. Furthermore, it has a modulus of elasticity at room temperature of 171 GPa and a thermal conductivity λ of 24 W/mK.

Table 1 compares further physical properties of the two alloys.

TABLE 1 physical properties of the various materials

| | Density in g/cm$^3$ | Coefficient of thermal expansion in K$^{-1}$ |
|---|---|---|
| γ-Ti-Al | 4 | $10 \times 10^{-6}$ |
| Stainless steel | 7.9 | $18.6 \times 10^{-6}$ |

Since the rotating components of the high-pressure compressor of a gas turbine installation are subject to high thermal loads of temperatures of up to approx. 600° C., the reduction in the weight of the rotor according to the invention has advantageous effects on increasing the service life of the turbomachine.

The intermetallic intermediate pieces are produced in a known way by casting, hot isostatic pressing and heat treatment with minimal remachining.

Of course, the invention is not restricted to the exemplary embodiment described.

The intermediate piece 4 of the high-pressure compressor may, for example, also be made from a known intermetallic orthorhombic titanium aluminide alloy with a density of 4.55 g/cm$^3$. Orthorhombic titanium aluminide alloys are based on the ordered compound $Ti_2AlNb$ and have the following chemical composition: Ti-(22–27)Al-(21–27)Nb. According to the invention, it is also conceivable to use a high-temperature titanium alloy which, by way of example, has the following chemical composition (details in % by weight): 0.06 C, 0.4 Si, 5.8 Al, 4 Sn, 4 Zr,0.5 Mo, <0.05 Fe, 0.11 O, <0.03 N, <0.006H, remainder Ti.

Furthermore, it is possible for the invention to be used not only for high-pressure compressor rotors but also for turbine rotors with turbine blades made from a superalloy, for example a nickel-based superalloy, in which the intermediate pieces between the rotor blades consist, for example, of an intermetallic y-titanium aluminide alloy or an intermetallic orthorhombic titanium aluminide alloy. This too advantageously makes it possible to achieve reductions in weight and an increase in the service life of the turbomachine.

The brittleness of the intermetallic Ti—Al alloys has no adverse effect for the use of these materials in accordance with the invention as described above, since, as intermediate pieces, they are not exposed to any abrasive contact or frictional wear.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

| | |
|---|---|
| 1 | Rotor |
| 2 | Stator |
| 3, 3' | Rotor blade |
| 4 | Intermediate piece |
| 5 | Guide vane |
| $D_1$ | Density of the rotor material |
| $D_2$ | Density of the intermediate piece |

The invention claimed is:

1. An axial-flow thermal turbomachine comprising:

a rotor made from a metallic material with a first density ($D_1$);

a circumferential groove; and rotor blades and intermediate pieces alternatingly mounted in the circumferential groove;

wherein said intermediate pieces comprise a material with a second density ($D_2$) lower than the first density ($D_1$).

2. The turbomachine as claimed in claim 1, wherein the material having the second density ($D_2$) comprises an intermetallic compound.

3. The turbomachine as claimed in claim 2, wherein said intermetallic compound comprises an alloy selected from the group consisting of a y-titanium aluminide alloy and an orthorhombic titanium aluminide alloy.

4. The turbomachine as claimed in claim 3, wherein said γ-titanium aluminide alloy has the following chemical composition (in % by weight): Ti-(30.5–31.5)Al-(8.9–9.5)W-(0.3–0.4)Si.

5. The turbomachine as claimed in claim 1, wherein the material having the second density ($D_2$) comprises a titanium alloy.

6. The turbomachine as claimed in claim 1, wherein the turbomachine comprises a gas turbine having a high-pressure compressor with a rotor which comprises a stainless Cr—Ni steel.

* * * * *